US011527349B2

(12) United States Patent
Cobos Reyes et al.

(10) Patent No.: US 11,527,349 B2
(45) Date of Patent: Dec. 13, 2022

(54) INDUCTOR DEVICE WITH LIGHT WEIGHT CONFIGURATION

(71) Applicant: PREMO, S.A., Campanillas MA (ES)

(72) Inventors: Sergio Cobos Reyes, Málaga (ES); Claudio Cañete Cabeza, Benalmádena (ES); Antonio Rojas Cuevas, Málaga (ES); Jorge Rodríguez, Málaga (ES); Francisco Ezequiel Navarro Pérez, Barcelona (ES)

( * ) Notice: Subject to any disclaimer, the term of this patent is extended or adjusted under 35 U.S.C. 154(b) by 874 days.

(21) Appl. No.: 16/199,513

(22) Filed: Nov. 26, 2018

(65) Prior Publication Data

US 2019/0164680 A1 May 30, 2019

(30) Foreign Application Priority Data

Nov. 27, 2017 (EP) ..... 17382800

(51) Int. Cl.
*H01F 27/28* (2006.01)
*H01F 27/245* (2006.01)
(Continued)

(52) U.S. Cl.
CPC ..... *H01F 27/245* (2013.01); *H01F 3/10* (2013.01); *H01F 27/263* (2013.01);
(Continued)

(58) Field of Classification Search
CPC .. H01F 27/2866; H01F 27/324; H01F 27/245; H01F 27/325; H01F 27/263; H01F 27/266; H01F 2003/005
(Continued)

(56) References Cited

U.S. PATENT DOCUMENTS 3,927,397 A * 12/1975 Chow ..... H01F 7/0278 365/2
4,068,219 A * 1/1978 Chow ..... H01F 7/0278 365/27
(Continued)

FOREIGN PATENT DOCUMENTS

CN 103947038 A * 7/2014 ..... G06K 19/047
CN 203910451 U * 10/2014
(Continued)

*Primary Examiner* — Elvin G Enad
*Assistant Examiner* — Joselito S. Baisa
(74) *Attorney, Agent, or Firm* — Eugenio J. Torres-Oyola; Victor M. Rodriguez-Reyes; Rafael Rodriguez-Muriel

(57) ABSTRACT

Inductor device comprising a rectangular prismatic electro-insulating support (10) with three pairs of parallel outer faces (11) defining orthogonal axis (X, Y, Z), and defining eight corners; a rectangular prismatic magnetic core (20) supported by said electro-insulating support (10); and three conductor wire windings (DX, DY, DZ) wound around the three axis (X, Y, Z) surrounding the magnetic core (20); wherein the magnetic core (20) is a hollow magnetic core (20) composed by three pairs of sheets (21), each pair of sheets (21) being composed by two parallel sheets (21) facing each other perpendicular to one of said axis (X, Y, Z), and wherein each sheet (21) is made of a magnetic material, said sheet (21) being in contact and attached to the electro-insulating support (10) and being in contact with the surrounding orthogonal sheets (21).

17 Claims, 5 Drawing Sheets

(51) Int. Cl.
*H01F 27/26* (2006.01)
*H01F 3/10* (2006.01)
*H01F 27/32* (2006.01)
*H01F 5/02* (2006.01)

(52) U.S. Cl.
CPC ..... *H01F 27/266* (2013.01); *H01F 27/2866* (2013.01); *H01F 27/324* (2013.01); *H01F 2005/027* (2013.01)

(58) Field of Classification Search
USPC ..... 336/170
See application file for complete search history.

(56) References Cited

U.S. PATENT DOCUMENTS 4,706,057 A * 11/1987 Schwab ..... G01R 33/383 335/304
4,999,600 A * 3/1991 Aubert ..... H01F 7/0278 324/318
5,798,680 A * 8/1998 Abele ..... G01R 33/3806 335/304
7,042,411 B2 * 5/2006 Yagi ..... H01Q 7/06 343/787
7,295,168 B2 * 11/2007 Saegusa ..... H01Q 7/00 343/787
7,365,623 B2 * 4/2008 Xia ..... G01R 33/3802 324/318
7,755,558 B2 * 7/2010 Ueda ..... H01Q 21/24 343/788
8,077,106 B2 * 12/2011 Sato ..... H01Q 7/08 343/788
9,016,580 B2 * 4/2015 Tsai ..... G06K 7/1443 235/462.09
10,707,565 B2 * 7/2020 Navarro Perez ..... H01Q 1/2216
2013/0178153 A1 * 7/2013 Thoen ..... H04B 5/0087 455/41.1
2016/0028242 A1 * 1/2016 Turki ..... H01F 38/14 307/104
2016/0365636 A1 * 12/2016 Cobos Reyes ..... H01Q 1/12
2019/0279812 A1 * 9/2019 Rojas Cuevas ..... H01Q 7/06

FOREIGN PATENT DOCUMENTS

JP 11204340 A * 7/1999
JP 2006194602 A * 7/2006
WO WO-9419811 A1 * 9/1994 ..... H01F 27/245
WO WO-2005045992 A1 * 5/2005 ..... H01F 41/04
WO WO-2013099546 A1 * 7/2013 ..... G06K 19/047

* cited by examiner

INDUCTOR DEVICE WITH LIGHT WEIGHT CONFIGURATION

This Non-Provisional application claims priority to and the benefit of EP 17382800 filed on 27 Nov. 2017, the content of which is incorporated herein by reference in its entirety.

TECHNICAL FIELD

The present invention relates to an inductor device, said inductor device including a magnetic core, an electrically insulating support supporting said magnetic core and three windings of conductive wire, arranged orthogonal to one another, wound surrounding said magnetic core.

An antenna can be built using the mentioned inductor device, particularly a low-frequency transmitting or receiving antenna. A preferred use of said antenna is detecting and/or transmitting the position and movement of objects that require precise control such as those used, for example, in virtual reality systems in which an electromagnetic system must have the capacity to locate in the virtual (or digital) world, the actual object of the physical world in an exact relative location and with the actual movements, speeds and accelerations in the three spatial coordinate components thereof. This objective can be achieved based on the principle that the response in terms of voltage induced by the magnetic field induction unit of a low-frequency inductor is directly proportional to the relative position thereof with respect to the field source.

The inductor device of the present invention forming a three-axis magnetic inductor or sensor can be configured for generating a standard electromagnetic field that is isotropic, has constant frequency and intensity as well as identical characteristics in the three orthogonal coils wound surrounding one and the same core. It is thereby possible to induce in said inductor or component wound on three orthogonal axes a voltage having a modulus proportional to the relative distance with respect to the source (position indication) and three coordinates x, y, z the relationship of which determines the angle of rotation with respect to the source position vector. The proposed inductor thereby generates a vector reference system orthogonal in three dimensions (R3) corresponding to the vector induction components of its three orthogonal windings. Any other receiving inductor introduced in the reference system will receive in each axis a voltage proportional to its vector distance, the angle of rotation of the receptor with respect to the reference system being determined by the ratio between the voltage of each axis and the entire module.

STATE OF THE ART

In the state of the art there are inductive component applications used as receiver elements in near-field or low-frequency applications when working as receiver antennas for NFC, RFID, or any near-field communications application at less than 13.56 MHz and in particular and preferably in bands between 10 KHz and 134 KHZ that cover RFID, NFC and EM Tracking applications as well as solutions for V2V communications or for the integration of LF active antennas into smartphones.

These known antennas are purely passive or amplified (active) transmitting or receiving antennas, being their performance limited by the minimal weight requirements in these applications.

It is known that the greater the size and the permeability of the magnetic cores, the greater the sensitivity of identical windings. Because inductive devices always tend to be as small as possible to maximize their integration capability, the density of devices tends to grow. It is known that there is a direct correlation between the permeability of a magnetic core and its density, having greater magnetic permeability those materials that have higher densities. Thus, a magnetic core made of Mn Zn presents initial magnetic permeability of 1000 to 10000 with densities around 4 Tm/m3. On the other hand, a magnetic core made of Fe Si alloy at 4% presents a permeability of between 20000 and 5000 with densities of 8 Tm/m3, and finally a magnetic core made of Mumetal Fe Ni presents magnetic permeability of 200000 with densities close to 9 Tm/m3.

The state of the art is the use of magnetic cores as small as possible, solids, generally being the limiting factor of the component or transmitting/receiving antenna the volume and size and not its weight.

Patent document U.S. Pat. No. 4,287,809 (Honeywell) discloses an electromagnetic system for determining the orientation, including the position of a helmet, including a transmitting antenna for transmitting electromagnetic field vectors, a receiving antenna for sensing said electromagnetic field vectors and a control apparatus for determining the orientation, including the location of the helmet, depending on said transmitted and sensed electromagnetic field vectors. FIG. 3 of the drawings of this patent document describes a possible embodiment of the transmitting and receiving antennas used, in which they can be seen to comprise a ferrite core around which three windings are wound orthogonal to one another.

Patent document U.S. Pat. No. 4,210,859 (Technion Research) likewise describes a structure for a three-dimensional antenna with three orthogonal windings, respectively, likewise suitable for providing an inductor such as the one referred to in this invention. FIG. 17 of the drawings shows a particular embodiment of the magnetic core of the inductor in the shape of a cube with protuberances at its vertexes defining winding up channels for arranging the mentioned orthogonal windings.

On the other hand, patent document EP 1315178 (ABB) describes an electromagnetic inductor configuration comprising a cubic core and three orthogonal windings supported on the faces of two hollow half cubes formed from an insulating plastic material and provided at the vertexes thereof with protuberances, the magnetic core being arranged inside the cavities of said two half cubes arranged with the open faces thereof opposite one another.

Document WO2016141373A1 describes different configurations directed to the reduction of the magnetic core weight, shown on FIGS. 12A to 12E.

FIG. 12B shows a magnetic core composed by multiple stacked parallel sheets, and FIG. 12D shows a solid magnetic core having three-axes orthogonal passing through holes, but none of the proposed solutions proposes a magnetic core optimized for offering maximum area perpendicular to three orthogonal magnetic fields and minimum weight.

BRIEF DESCRIPTION OF THE INVENTION

The present invention is related to an inductor device with light weight configuration, where the weight optimization has not sacrificed the capabilities of the device as transmitting/receiving antenna and where the ratio Q/weight and Sensibility/weight has been maximized.

Said inductive device includes a composite magnetic core, so that magnetic operation is obtained in the same way as that of a monolithic magnetic core but, it is formed by a plurality of discrete elements in the form of sheets, also called thin plates, that present the maximum cross-section to the incident magnetic field but of a minimum thickness in the remaining dimension.

The combination of six of these sheets can form a cube, each sheet being a single layer of magnetic material or multiple layers of magnetic material stacked together.

The inductor device of this invention can even be applied in very low weight 3Dcoil RFID antennas, improving for example reliability aspects where mass is critical such as vibration resistance or drop test.

In detail the proposed inductor device with low weight configuration comprises:

- a rectangular prismatic electro-insulating support with three pairs of parallel outer faces defining one axis, one axis, and one axis orthogonal to each other perpendicular to said outer faces and defining eight corners, one on each intersection between three orthogonal outer faces;
- a rectangular prismatic magnetic core supported by said electro-insulating support;
- three conductor wire windings arranged orthogonal to each other, wound around the three-axis surrounding the magnetic core.

Unlike the indicated solutions from the state of the art, the present invention provides an electrically insulating support, generally a cubic support, supporting the also cubic magnetic core.

Said electro-insulating support can be obtained, for example, by means of high-precision injection molding, which allows the obtention of a high precision electro-insulating support on which the magnetic core can be precisely fixed.

The present invention also proposes the following features:

- the magnetic core is a hollow magnetic core composed by three pairs of sheets, each pair of sheets being composed by two parallel sheets facing each other perpendicular to one of said axis, and wherein
- each sheet is made of a magnetic material, has two parallel main faces on opposed sides of the sheet, said main faces being surrounded by a perimetral area, said sheet being in contact and attached to the electro-insulating support through one of said main faces, and being in contact with the surrounding orthogonal sheets through said perimetral area.

According to the proposed invention the magnetic core is composed by six different sheets, preferably flat sheets with uniform thickness. The sheets are facing each other two by two creating three pairs of sheets, each sheet of each pair of sheets being perpendicular to one of the three orthogonal axis and being in contact with the surrounding orthogonal sheets by its perimetral area. The combination of the six sheets creates a box-like magnetic core with a hollow interior.

The main faces of the proposed hollow magnetic core offer maximum surface perpendicular to each magnetic field generated by the three orthogonal wire windings providing an elevated performance, especially providing an elevated sensitivity (that is proportional to the antenna gain) when the inductor device us used as a transmitting or receiving antenna.

At the same time the hollow interior of the magnetic core reduces its weight without affecting its performance in comparison with a similar size inductor device with a solid magnetic core.

As a result, the present invention provides an inductor device with optimized and high ratio weight/performance, specially appreciated in some applications where the weight is a relevant factor, like its use in wearable devices.

Optionally the perimetral area of the sheets can be at least partially beveled. Said beveled perimetral area can be attached to a complementary beveled perimetral area of an adjacent sheet assuring a perfect contact there between.

According to an additional embodiment of the present invention:

- the electro-insulating support has a rectangular prismatic hollow inner chamber defined by inner faces of the electro-insulating support which are parallel to the outer faces,
- all or all but one of the sheets have one main face of each sheet attached to one inner face of the electro-insulating support; and
- the wire windings are wound around and in contact with the outer faces of the electro-insulating support.

That is, the electro-insulating support is hollow defining an inner chamber which is surrounded by walls of a constant width defined between the outer faces and the inner faces of the electro-insulating support. All or all but one of the sheets of the magnetic core have one main face attached to one inner face of the electro-insulating support.

In this case the inner chamber of the electro-insulating support is preferably accessible through an access opening defined at least in one of the outer faces of the electro-insulating support, being the access opening at least the same size as the hollow inner chamber, allowing the introduction of the sheets therein. Optionally the access opening is closed by an electro-insulating lid.

It is also proposed that said electro-insulating support can be composed by a first partial electro-insulating support, which contains part of the hollow inner chamber, and a second partial electro-insulating support, which contains the rest of the hollow inner chamber.

The assembly of both first and second partial electro-insulating supports creates the hollow electro-insulating support. When both first and second partial electro-insulating supports are disassembled the hollow inner chamber is accessible for the introduction of the sheets constitutive of the composed magnetic core.

Four outer and inner faces of the electro-insulating support can be divided between the first and the second partial electro-insulating supports.

Alternatively, three or four outer and inner faces of the electro-insulating support can be completely included in the first partial electro-insulating support and the other two or three outer and inner faces of the electro-insulating support can be completely included in the second partial electro-insulating support.

According to these embodiments wherein the electro-insulating support is hollow and contains the magnetic core, the electro-insulating support can include eight corner protrusions on the eight corners of the electro-insulating support, each corner protrusion including winding limiting faces perpendicular to the orthogonal outer faces coincident on said corner, each winding limiting face facing winding limiting faces of other corner protrusions defining winding channels there between. The windings are wound around the electro-insulating support within said winding channels assuring uniform and repetitive winding symmetry, said winding channels allowing fixing the spirals of the windings in an automatic high-speed winding up process on said electro-insulating support.

Alternatively, the electro-insulating support has only four corner protrusions on four corners surrounding one of the outer faces of the electro-insulating support, preferably surrounding the outer face opposed to the outer face where the access opening is defined. An electro-insulating support having only four corner protrusions can be easily molded in and unmolded from a two-part cast, being its production easier and cheaper.

According to an alternative embodiment of the present invention one main face of each sheet is attached to an outer face of the electro-insulating support, surrounding said electro-insulating support with the sheets constitutive of the magnetic core. The wire windings will be wound around and in contact with the main faces of the magnetic core not attached to the electro-insulating support.

In this case it is also proposed that:

the electro-insulating support includes four corner protrusions on at least four corners surrounding one of the outer faces of the electro-insulating support, or includes eight corner protrusions on the eight corners of the electro-insulating support, each corner protrusion including winding limiting faces perpendicular to the orthogonal outer faces coincident on said corner and facing winding limiting faces of other corner protrusions defining winding channels there between, and wherein the sheets include notches on its perimetral area complementary with the corner protrusions, said corner protrusions protruding from the magnetic core.

According to this embodiment the four or eight corner protrusions protrude from the magnetic core through the notches defined in the sheets that surround the electro-insulating support, defining winding channels that contain the main faces of the sheets wherein the winding is wound around.

As described above the solution with only four corner protrusions can be easily produced.

It is also proposed that each sheet can be a multilayer sheet, each layer being made of a magnetic material.

The magnetic material constitutive of each sheet can be made of ferrite, crystalline metal alloy, nano-crystalline metal alloy, amorphous metal alloy, or polymer bonded magnetics (PBM).

In an alternative embodiment the sheets are flexible, made of a flexible material.

Preferably the inductor device is included in a device selected among: an electronic wearable device, virtual reality glasses, remote control, remote control gloves, smart watch, helmet, tablet, smart phone, smart fabric.

In a preferred embodiment all the sheets are square-shaped and have equal size, equal thickness and equal magnetic permeability, and all the windings are equal to each other, producing an isometric inductor.

Alternatively, the sheets are square-shaped or rectangular-shaped and/or have different thickness and/or different magnetic permeability to each other and/or the windings are different to each other. If only one of those parameters is different the inductor device will be not an isometric inductor, but if multiple of those parameters are different to each other the inductor can be configured to obtain an isometric inductor.

For example, a non-squared-shape magnetic core can produce an isometric planar inductor if the smaller size of some sheets is compensated by having an increased thickness, an increased magnetic permeability, or using different windings on different axis, achieving the isometric behaviour of the inductor despite the cited irregularities.

Preferably said sheets, constitutive of the magnetic core, have a thickness equal or smaller than 0.5 mm.

Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and not limitative, in which.

DETAILED DESCRIPTION OF AN EMBODIMENT

Figure 1:
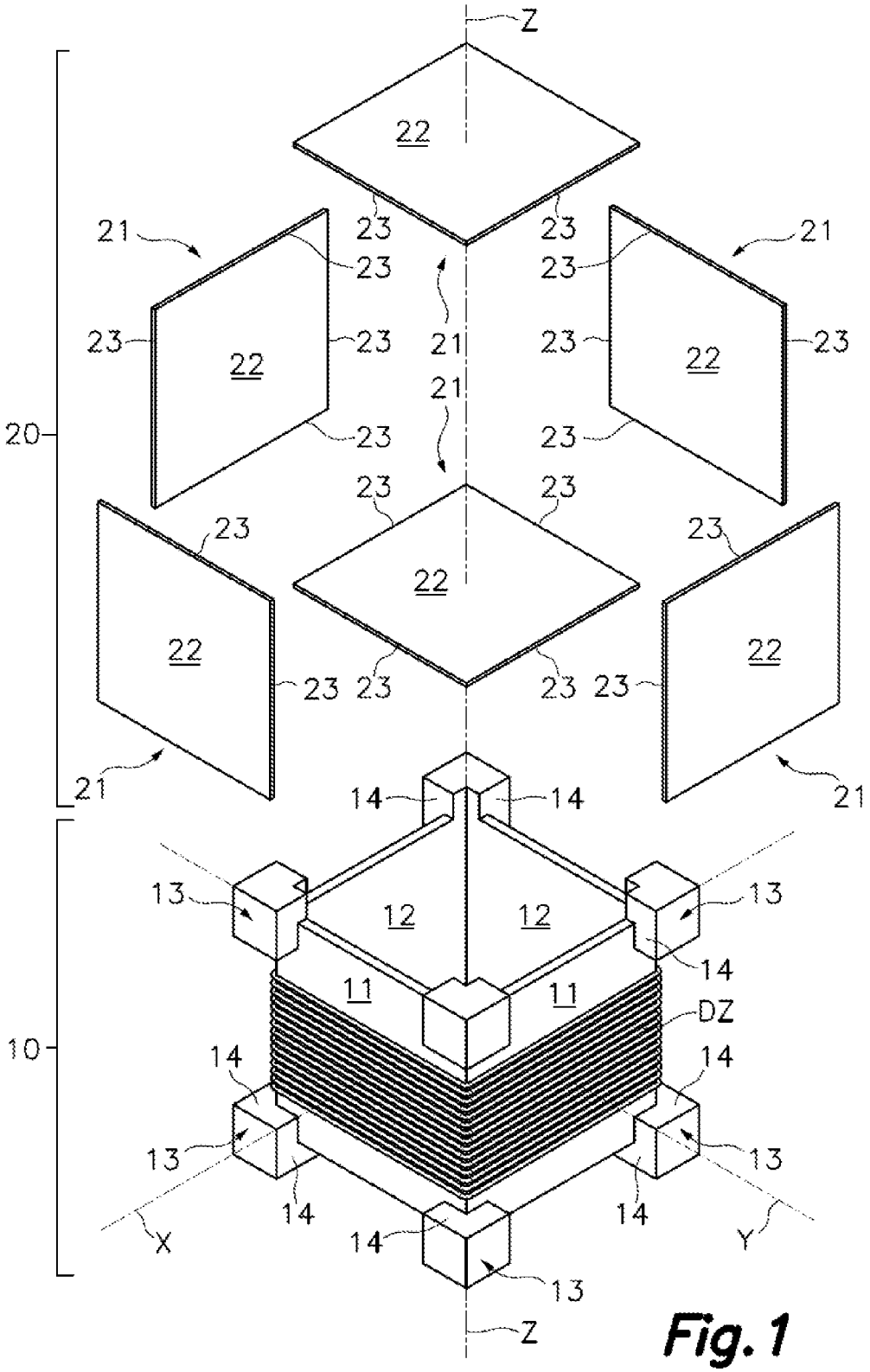
FIG. 1 shows an exploded perspective view according to a first embodiment in which the electro-insulating support is hollow and includes eight cube-shaped corner protrusions, wherein the sheets constitutive of the hollow magnetic core are squared defining an isometric inductor, are configured to be inserted in the inner chamber of the hollow electro-insulating support, said sheets being shown also in exploded array, and the electro-insulating support including one windings wound there around.
Figure 2:
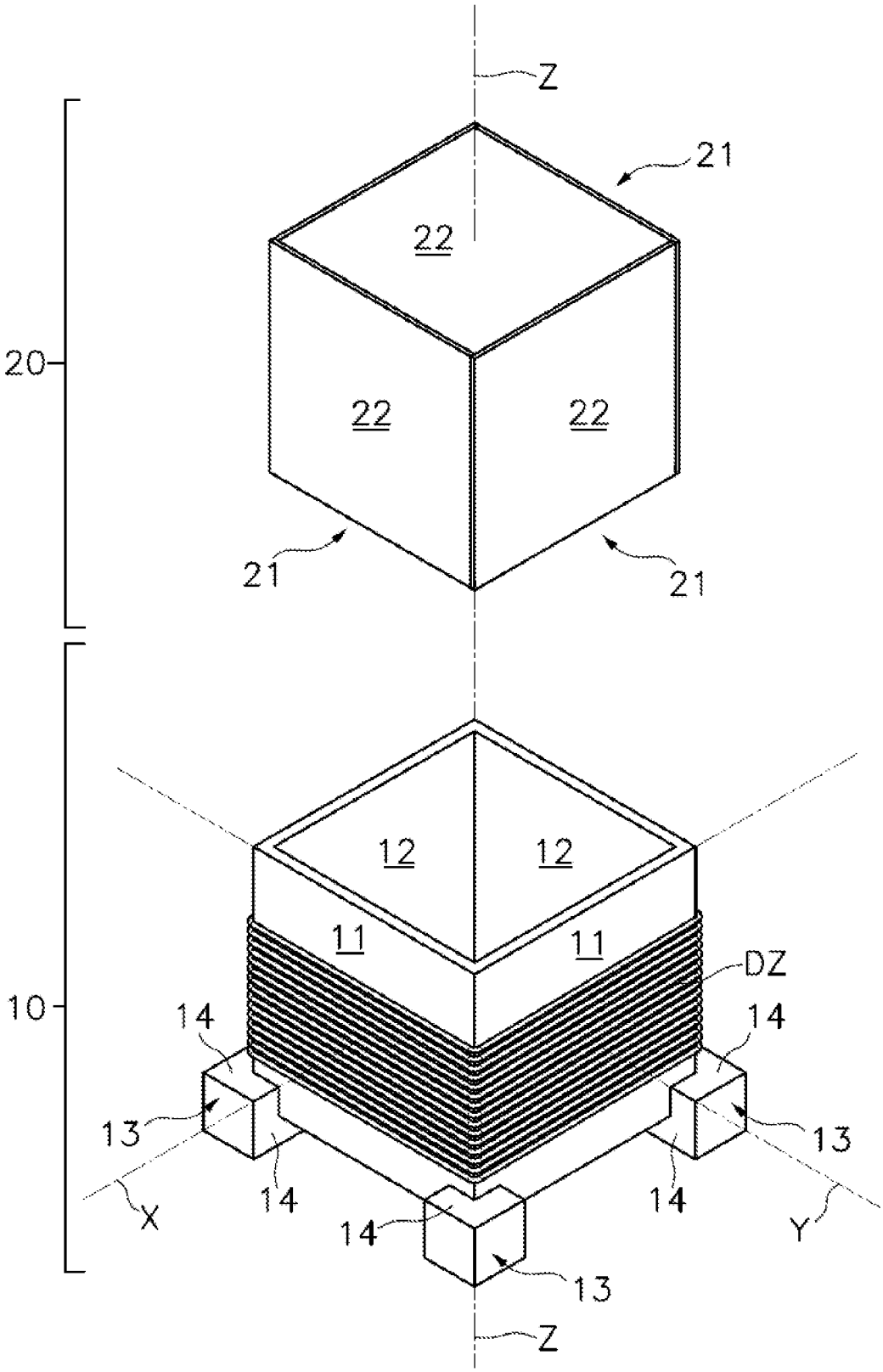
FIG. 2 shows a perspective view according to a second embodiment, like the first embodiment, in which the electro-insulating support is also hollow, but it includes only four corner protrusions. In this embodiment the six sheets (configured to be included within the inner chamber of the hollow electro-insulating support) constitutive of the magnetic core are shown in an assembled configuration defining a cubic and hollow magnetic core.

The foregoing and other advantages and features will be more fully understood from the following detailed description of an embodiment with reference to the accompanying drawings, to be taken in an illustrative and not limitative, in which:

The FIGS. 1 and 2 shows a first and second embodiments of the present invention in which an electro-insulating support 10, made of plastic, has three pairs of squared outer faces 11 defining a cube and three orthogonal axis X, Y and Z.

Said electro-insulating support 10 is hollow defining an inner chamber accessible through an access opening defined in one of the outer faces 11. The inner chamber is defined between five inner faces 12 of the electro-insulating support 10, parallel to the outer faces 11 thereof.

The access opening has the same size of the inner chamber, therefore one of the inner faces 12 corresponds with said access opening.

A hollow squared magnetic core 20 is fitted within said inner chamber. Said magnetic core 20 is constituted by six squared sheets 21 arranged in three pairs, each pair of sheets being orthogonal to the other pairs of sheets and including two parallel sheets facing each other.

Each sheet is made of a magnetic material, has a constant thickness for example below 0.5 mm, and has two opposed flat main faces 22 which are surrounded by a perimetral area 23.

Said six sheets are fitted in the inner chamber of the electro-insulating support 10, each sheet 21 having a main face 22 attached to one inner face 12 of the electro-insulating support 10, and having one perimetral area 23 in contact with the perimetral area 23 of a surrounding sheet 21.

Said perimetral areas 23 of the sheets 21 can be beveled in such a way that the contact with the surrounding sheets 21 will be produced through said beveled perimetral areas 23 of each sheet 21. Alternatively, the perimetral areas 23 can be in some cases coplanar with the main face 22 of the sheet 21 and in other cases perpendicular to the main face 22 of the sheet 21 in a flat edge, in such a way that a perimetral areas 23 coplanar with the main face 22 of a sheet 21 can be in contact with a perimetral areas 23 perpendicular to the main face 22 of an adjacent sheet 21.

This disposition of the sheets 21 defines a cube-shaped hollow magnetic core 20 fitted within the electro-insulating support 10.

Optionally the access opening can be sealed with an electro-insulating lid, which can be for example a plastic sheet or a resin or polymer poured and hardened on the access opening of the electro-insulating support 10 covering the magnetic core 20.

Figure 5:
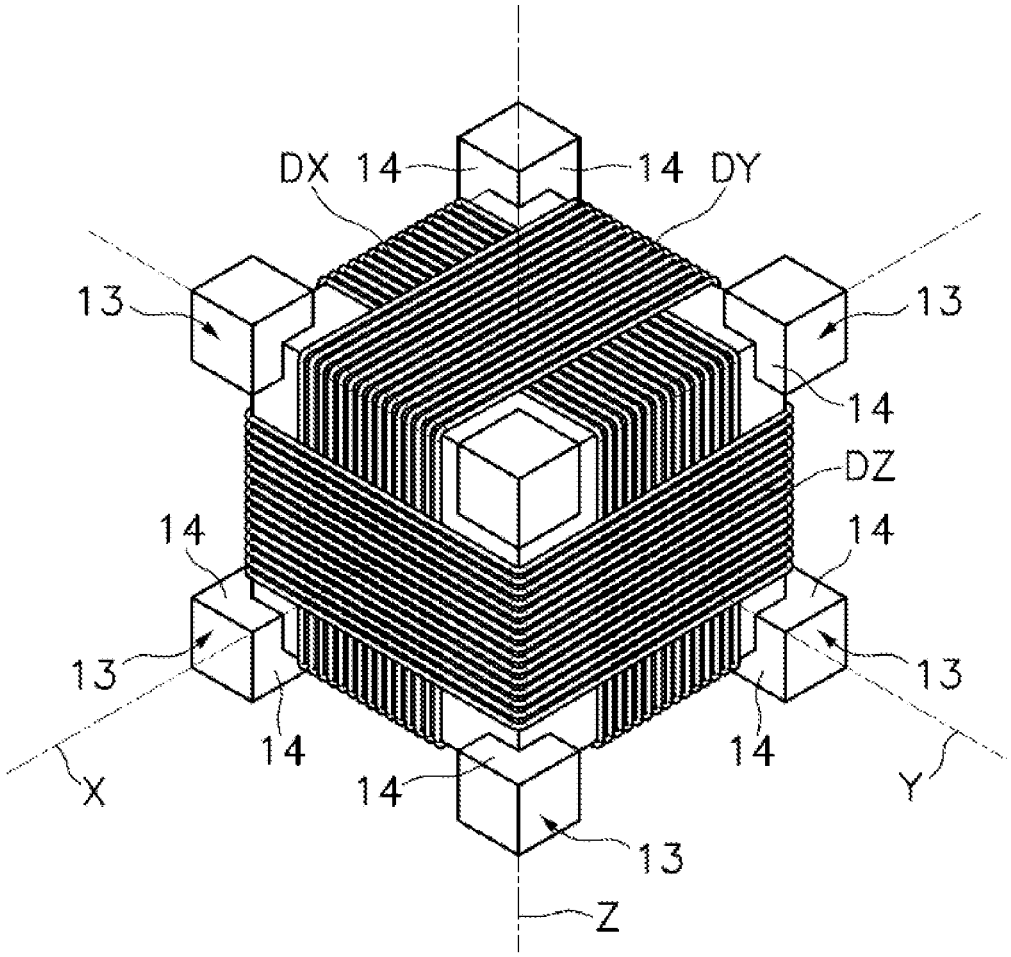
FIG. 5 shows a perspective view of the finished inductor device, according to any of the preceding embodiments, wherein the three windings are wounded around the magnetic core orthogonal to each other in the winding channels defined between the corner protrusions pf the electro-insulating support.

Once the magnetic core 20 is fitted within the inner chamber of the electro-insulating support 10 three windings DX, DY and DZ are wound around three orthogonal axis and supported on the outer faces 11 of the electro-insulating support 10, surrounding the magnetic core 20, said windings being orthogonal to each other, as shown on FIG. 5.

In addition, the electro-insulating support 10 can include a corner protrusion 13 on its corners, where three orthogonal outer faces 11 of the electro-insulating support 10 intersect to each other. Preferably said corner protrusions 13 can be included on the eight corers of the electro-insulating support 10, but it is also possible to include only four corner protrusions 13 on the corners of the electro-insulating support 10 spaced away from the access opening to the inner chamber, being this solution easier to manufacture in a cast.

In these embodiments the corner protrusions 13 are cube-shaped, and each corner protrusion 13 including winding limiting faces 14 perpendiculars to the outer faces 11 of the electro-insulating support 10. Each winding limiting face 14 faces a parallel winding limiting face of another corner protrusion 13 defining a winding channel there between where the windings DX, DY and DZ can be wound. Said corner protrusions 13 help to the correct positioning of the windings, allowing a precise automatic winding.

Corner protrusions 13 having winding limiting faces and having shapes other than cube-shaped are also contemplated.

Figure 3:
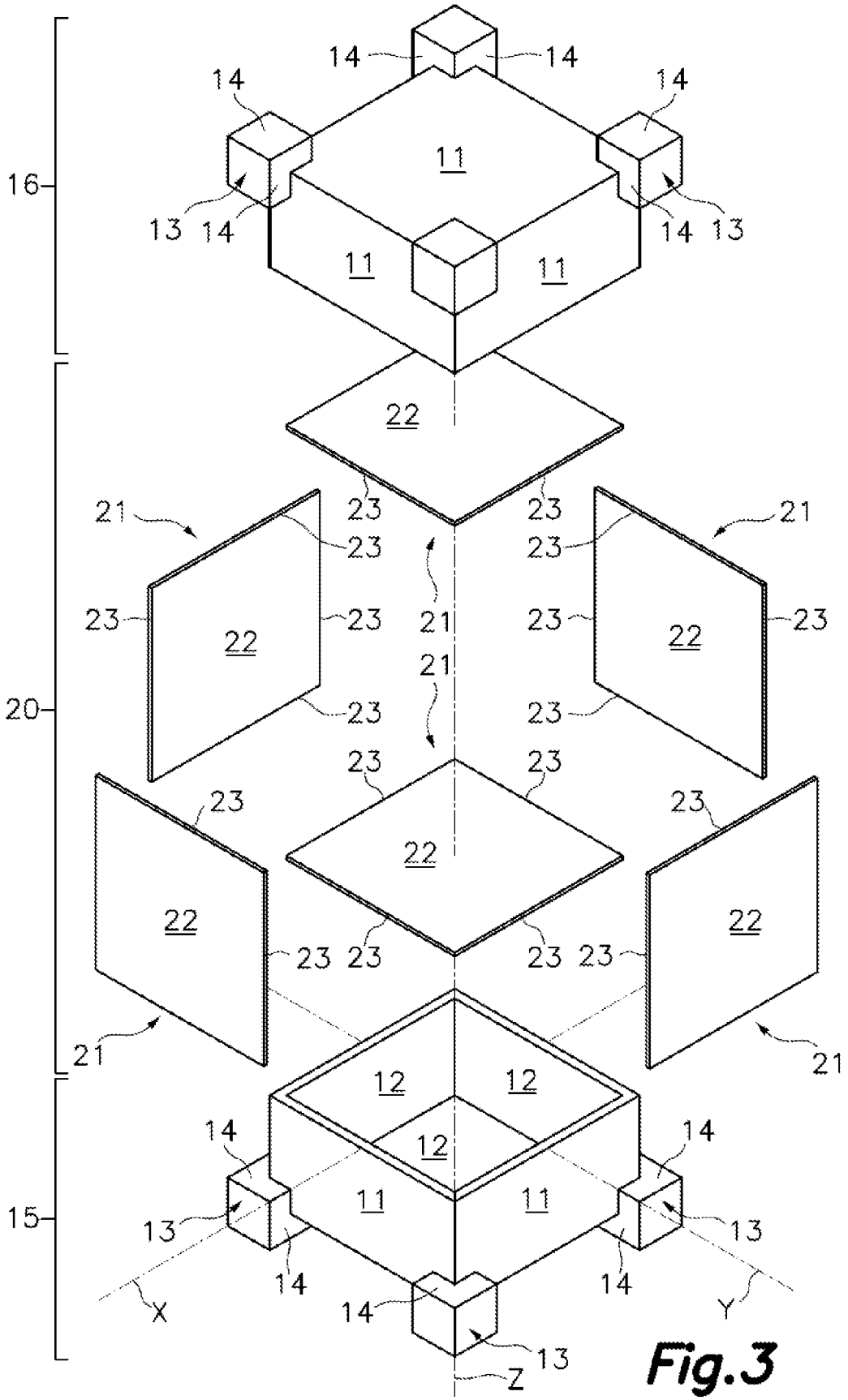
FIG. 3 shows a perspective view according to a third embodiment in which the electro-insulating support is also hollow, but it's constituted by two symmetric halves, being the magnetic core constituted by six sheets, shown in this figure in an exploded array, configured to be included within the inner chamber of the hollow electro-insulating support.

The third embodiment of the present invention, shown on FIG. 3, is similar to the first and second embodiments, having the same magnetic core 20 and the same corner protrusions 13 than said first and second embodiments. Of course, the corner protrusions 13 are optional features of this embodiment.

But the electro-insulating support 10 of this third embodiment is proposed to be composed by a first partial electro-insulating support 15, which contains part of the hollow inner chamber, and a second partial electro-insulating support 16, which contains the rest of the hollow inner chamber.

In the present embodiment this first and second partial electro-insulating supports 15, 16 are symmetric, and four outer faces 11 and four inner faces 12 of the electro-insulating support 10 are also divided between the first and second partial electro-insulating support 10. Despite the above other embodiments not shown on the figures are contemplated, for example one in where the first partial electro-insulating support 15 includes three complete outer faces 11 orthogonal to each other and correspondent three inner faces 12, and where the second partial electro-insulating support 16 includes the other three complete outer faces 11 orthogonal to each other.

When said first and second partial electro-insulating supports 15 and 16 are detached to each other, the inner chamber of the electro-insulating support 10 is accessible to insert the magnetic core 20 therein. Once the magnetic core 20 has been fitted in the inner chamber the first and second partial electro-insulating supports 15 and 16 can be coupled together facing and aligning to each other the parts of the inner chamber contained on each of said first and second partial electro-insulating support 15, 16. Because of said coupling an electro-insulating support 10 is obtained wherein the magnetic core 20 is completely housed and isolated.

The three orthogonal windings DX, DY, DZ can be wounded around the magnetic core 20 supported on the outer faces 11 of the electro-insulating support 10.

Figure 4:
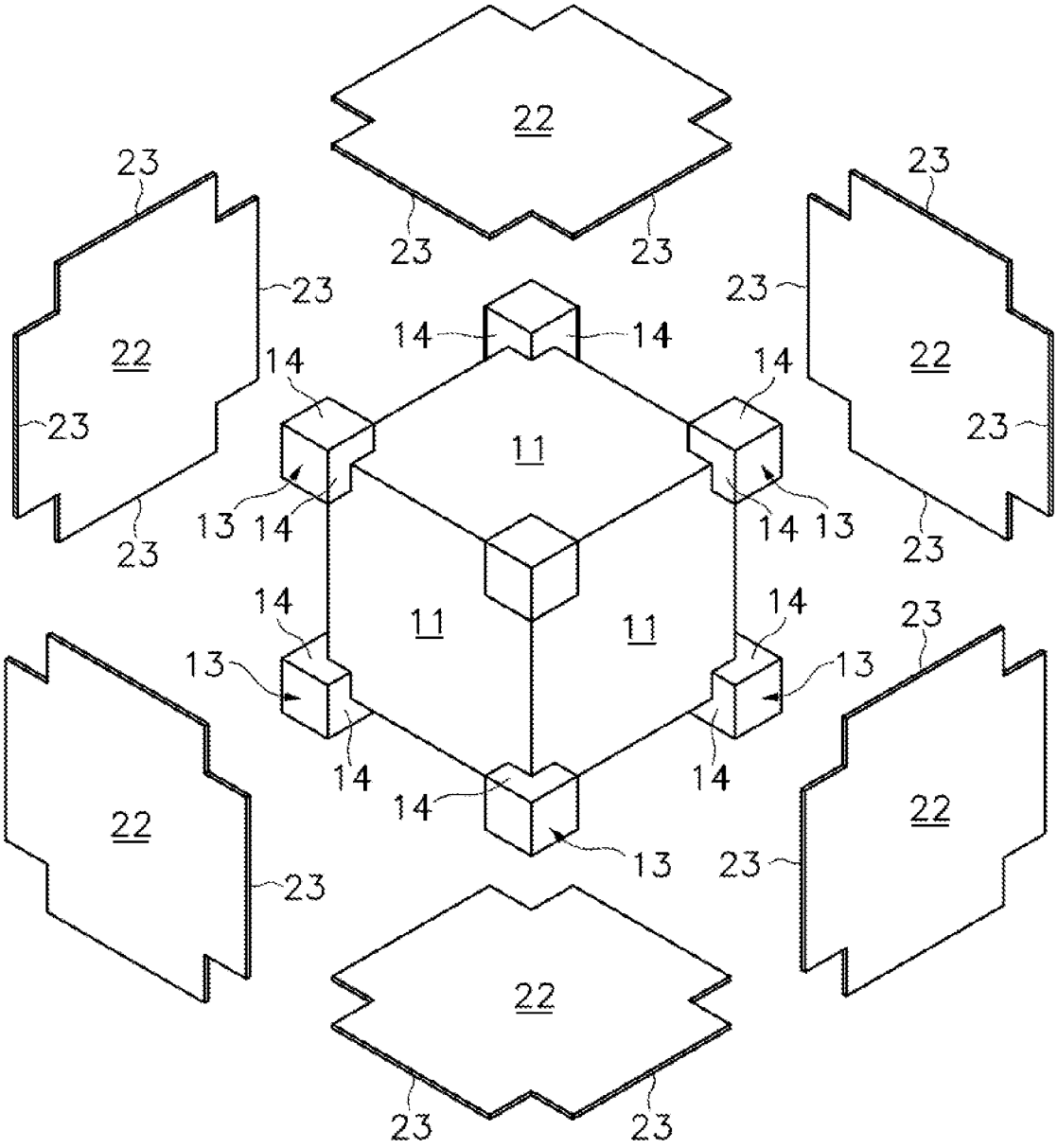
FIG. 4 shows a perspective view according to a fourth embodiment in which the sheets, shown in exploded array around the electro-insulating support, are squared sheets having a squared notch on each corner, and wherein the electro-insulating support includes eight cube-shaped corner protrusions complementary with the squared notches of the sheets in such a way that each sheet can be attached to one outer face of the electro-insulating support being one corner protrusion housed on each squared notch of said sheet and protruding from said sheet.

FIG. 4 shows a fourth embodiment of the present invention in which the electro-insulating support 10 is cube-shaped defining six outer faces 11, and wherein the six sheets 21 constitutive of the magnetic core 20 are attached surrounding the electro-insulating support 10, each sheet 21 having a main face 22 attached on one outer face 11 of the electro-insulating support 10.

Each sheet is made of a magnetic material, has a constant thickness for example below 0.5 mm, and has two opposed flat main faces 22 which are surrounded by a perimetral area 23.

Said six sheets are attached surrounding the electro-insulating support 10, each sheet 21 having one perimetral area 23 in contact with the perimetral area 23 of a surrounding sheet 21. Said perimetral areas 23 of the sheets 21 can be beveled in such a way that the contact with the surrounding sheets 21 will be produced through said beveled perimetral areas 23 of each sheet 21.

According to the present fourth embodiment the three orthogonal windings DX, DY, DZ are supported directly on the sheets 21. Preferably in this case the windings will be made of isolated coils.

In this embodiment the electro-insulating support 10 can be hollow in order to reduce its weight but it is not essential because the plastic weight is lower than the magnetic material weight.

Preferably the electro-insulating support 10 of this fourth embodiment also has corner protrusions 13 similar to those corner protrusions defined above in the previous embodiments. In this case the sheets 21 constitutive of the magnetic core 20 shall include notches on its corners, being said notches complementary to the corner protrusions 13 of the electro-insulating support 10, so that when the sheets 21 are attached around the electro-insulating support 10 the corner protrusions 13 does not interfere with said sheets 21 and protrude from the magnetic core 20 defining the winding channels on the outer main faces 22 of the sheets 21.

The wounding of the windings DX, DY and DZ as shown on FIG. 5 around the magnetic core will produce a similar inductor device in the first, second, third or fourth embodiments. The only differences will be that in the first, second and third embodiments the windings DX, DY and DZ the are supported on the electro-insulating support 10, but in the fourth embodiment the windings DX, DY, DZ are supported directly on the magnetic core 20.

The inductor device resulting from the second embodiment will have only four corner protrusions 13. In this case it is proposed to attach four provisional detachable corner protrusions during the winding operations in order to define temporary winding channels.

As will be understood by an expert, any embodiment of this invention can be adapted having a non-cube-shaped configuration, but having a prismatic configuration, without escaping the scope of protection of the present patent application.

Said non-cube-shaped configuration can provide a non-isometric inductor device, but it can also provide an isometric inductor device, for example a planar isometric device. This can be achieved producing at least two asymmetries which compensate to each other.

For example, if one pair of sheets 21 are squared, and the other sheets 21 are rectangular, using different thickness of the sheets 21, different magnetic conductivity of the sheets 21, or even a different number of turns on the different windings can compensate the differences produced by the different shape of the sheets 21, providing an isometric inductor device.

It will be understood that various parts of one embodiment of the invention can be freely combined with parts described in other embodiments, even being said combination not explicitly described, provided there is no harm in such combination.

The invention claimed is:

1. Inductor device with light weight configuration, comprising:

a rectangular prismatic electro-insulating support with three pairs of parallel outer faces defining three axes X, Y and Z orthogonal to each other perpendicular to said outer faces and providing eight corner protrusions, one on each corner defined by the intersection between three of said outer faces;

a rectangular prismatic isotropic magnetic core supported by said electro-insulating support; and three conductor wire windings arranged orthogonal to each other, wound around the three axes X, Y and Z surrounding the magnetic core;

wherein:

the magnetic core is a hollow box-like magnetic core with a hollow interior composed by three pairs of sheets confining the hollow interior of the magnetic core, each pair of sheets being composed by two parallel sheets facing each other perpendicular to one of said axes X, Y and Z;

each sheet is a thin plate made of a magnetic material, has two parallel main faces on opposed sides of the sheet, said main faces being surrounded by a perimetral area, said sheet being in contact and attached to the electro-insulating support through one of said main faces, and being in contact with the surrounding orthogonal sheets through said perimetral area;

the perimetral area of each sheet is at least partially beveled and is attached to a complementary beveled perimetral area of an adjacent sheet.

2. Inductor according to claim 1 wherein:

the electro-insulating support has a rectangular prismatic hollow inner chamber defined by inner faces of the electro-insulating support which are parallel to the outer faces, all or all but one of the sheets have one main faces attached to one inner face of the electro-insulating support; and the wire windings are wound around and in contact with the outer faces of the electro-insulating support.

3. Inductor according to claim 2 wherein said inner chamber is accessible through an access opening defined at least in one of the outer faces of the electro-insulating support, being the access opening at least the same size as the hollow inner chamber.

4. Inductor according to claim 3 wherein the access opening is closed by an electro-insulating lid.

5. Inductor according to claim 2 wherein said electro-insulating support is composed by a first partial electro-insulating support, which contains part of the hollow inner chamber, and a second partial electro-insulating support, which contains the rest of the hollow inner chamber.

6. Inductor according to claim 5 wherein the electro-insulating support includes four corner protrusions on at least four corners surrounding one of the outer faces of the electro-insulating support, or includes eight corner protrusions on the eight corners of the electro-insulating support, each corner protrusion including winding limiting faces perpendicular to the orthogonal outer faces coincident on said corner, each winding limiting face facing winding limiting faces of other corner protrusions defining winding channels there between.

7. Inductor according to claim 2 wherein the electro-insulating support includes four corner protrusions on at least four corners surrounding one of the outer faces of the electro-insulating support, or includes eight corner protrusions on the eight corners of the electro-insulating support, each corner protrusion including winding limiting faces perpendicular to the orthogonal outer faces coincident on said corner, each winding limiting face facing winding limiting faces of other corner protrusions defining winding channels there between.

8. Inductor according to claim 1 wherein one main face of each sheet is attached to an outer face of the electro-insulating support, the wire windings being wound around and in contact with the main faces of the magnetic core not attached to the electro-insulating support.

9. Inductor according to claim 8 wherein:

the electro-insulating support includes four corner protrusions on at least four corners surrounding one of the outer faces of the electro-insulating support, or includes eight corner protrusions on the eight corners of the electro-insulating support, each corner protrusion including winding limiting faces perpendicular to the orthogonal outer faces coincident on said corner and facing winding limiting faces of other corner protrusions defining winding channels there between, and wherein the sheets include notches on its perimetral area complementary with the corner protrusions, said corner protrusions protruding from the magnetic core.

10. Inductor according to claim 1 wherein each sheet is a multilayer sheet, each layer being made of a magnetic material.

11. Inductor according to claim 1 wherein all the sheets are square-shaped and have equal size, equal thickness and equal magnetic permeability, and all the windings are equal to each other, producing an isometric inductor.

12. Inductor according to claim 1 wherein the sheets are square-shaped or rectangular-shaped and/or have different thickness and/or different magnetic permeability to each other and/or the windings are different to each other.

13. Inductor according to claim 1 wherein the magnetic material constitutive of each sheet is made of ferrite, crystalline metal alloy, nano-crystalline metal alloy, amorphous metal alloy, or polymer bonded magnetics.

14. Inductor according to claim 1 wherein the sheets are flexible.

15. Inductor according to claim 1 wherein the inductor device is included in a device selected among: an electronic wearable device, virtual reality glasses, remote control, remote control gloves, smart watch, helmet, tablet, smart phone, smart fabric.

16. Inductor according to claim 1 wherein the inductor device is included in a device selected among: an electronic wearable device, virtual reality glasses, remote control, remote control gloves, smart watch, helmet, tablet, smart phone, smart fabric.

17. Electronic wearable device including an inductor device with light weight configuration, comprising:

a rectangular prismatic electro-insulating support with three pairs of parallel outer faces defining three axes X, Y and Z orthogonal to each other perpendicular to said outer faces and providing eight corner protrusions, one on each corner defined by the intersection between three of said outer faces;

a rectangular prismatic isotropic magnetic core supported by said electro-insulating support;

three conductor wire windings arranged orthogonal to each other, wound around the three axis axes X, Y and Z and surrounding the magnetic core;

wherein:

the magnetic core is a hollow box-like magnetic core with a hollow interior composed by three pairs of sheets confining the hollow interior of the magnetic core, each pair of sheets being composed by two parallel sheets facing each other perpendicular to one of said axes X, Y and Z;

each sheet is a thin plate made of a magnetic material, has two parallel main faces on opposed sides of the sheet, said main faces being surrounded by a perimetral area, said sheet being in contact and attached to the electro-insulating support through one of said main faces, and being in contact with the surrounding orthogonal sheets through said perimetral area;

the perimetral area of each sheet is at least partially beveled and is attached to a complementary beveled perimetral area of an adjacent sheet.

* * * * *